United States Patent [19]

Hamm

[11] 3,945,156

[45] Mar. 23, 1976

[54] INFLATABLE BUILDING CONSTRUCTION

[76] Inventor: Wilfried Hamm, Lutherstrasse 33, 4330 Mulheim (Ruhr), Germany

[22] Filed: May 30, 1974

[21] Appl. No.: 474,371

[30] Foreign Application Priority Data

June 6, 1973 Germany ..... 2328691

[52] U.S. Cl. ..... 52/2; 52/63; 52/81

[51] Int. Cl.[2] ..... E04B 1/34; E04B 1/347

[58] Field of Search ..... 52/2, 63, 222; 135/15 CF

[56] References Cited

UNITED STATES PATENTS

| | | | |
|---|---|---|---|
| 2,277,742 | 3/1942 | Crawford | 135/15 CF |
| 2,979,064 | 4/1961 | Fischer | 52/2 |
| 3,145,719 | 8/1964 | Johnson | 52/2 |
| 3,333,375 | 8/1967 | Johnston | 52/81 |
| 3,389,534 | 6/1968 | Pendleton | 53/180 |
| 3,625,235 | 12/1971 | Gorgichuk | 135/1 |
| 3,710,806 | 1/1973 | Kelly | 52/222 |
| 3,766,573 | 10/1973 | Burkholz | 52/63 |

FOREIGN PATENTS OR APPLICATIONS

| | | | |
|---|---|---|---|
| 1,176,643 | 1/1970 | United Kingdom | 52/222 |

*Primary Examiner*—John E. Murtagh
*Assistant Examiner*—William Randolph
*Attorney, Agent, or Firm*—McCormick, Paulding & Huber

[57] ABSTRACT

A building structure comprising a lattice-like network of support elements connected together at junctures to form a three-dimensional frame supporting a fabric-like canopy or skin laid thereover as an enclosure and wherein a resilient ball-like buffer is supported by the frame at each juncture point to engage the canopy and thus to prevent its direct engagement with the frame at the juncture points to reduce its wear and stress.

2 Claims, 3 Drawing Figures

FIG. 1
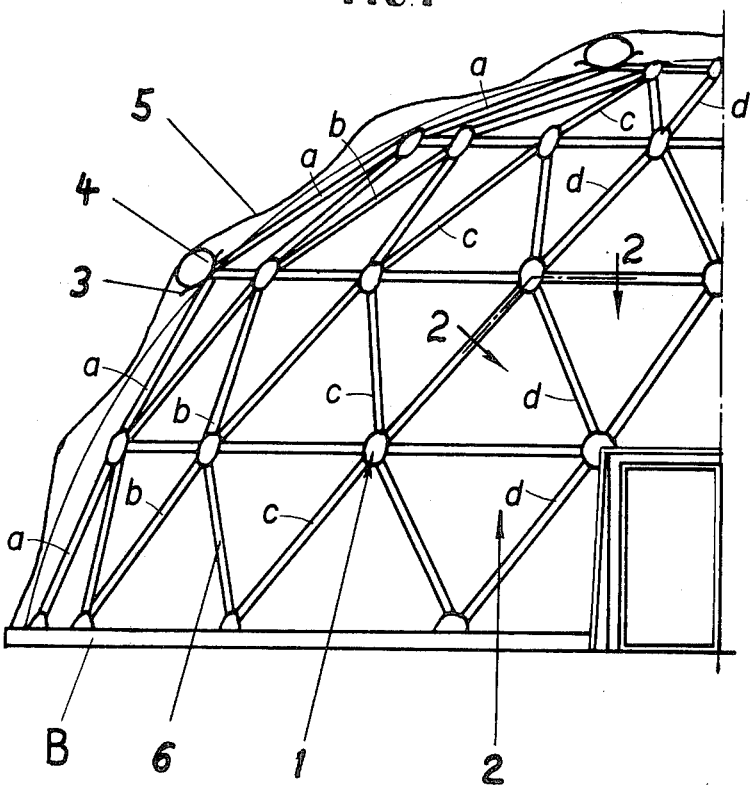
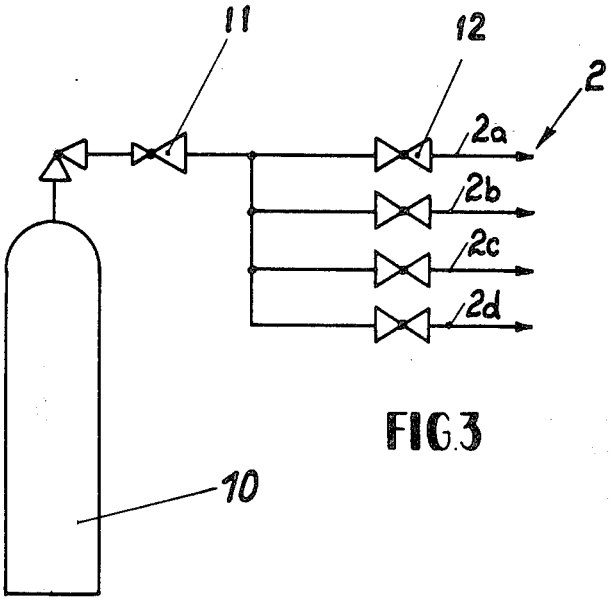
FIG. 3

INFLATABLE BUILDING CONSTRUCTION

BACKGROUND OF THE INVENTION

This invention relates to that field of building construction which utilizes a lattice-like three-dimensional frame structure covered by a flexible sheet canopy or skin to form an enclosure. The canopy is fabric-like in nature, but is very often a plastic film. The bottom edge of the canopy is secured to a base, and in some cases the interior of the enclosure which is formed is subjected to air at slightly greater than atmospheric pressure. In most cases, the canopy is not fastened to discrete portions of the frame, but merely engages the frame. This engagement of the canopy with the frame, particularly at the points of juncture of frame elements, causes wear and stress in the sheet material of the canopy, often resulting in rupture.

It is the general object of the present invention to provide means for supporting the canopy on the frame, particularly at frame juncture points, which will minimize the wear and stress in the sheet.

SUMMARY OF THE INVENTION

In accordance with the present invention, the frame structure comprises a lattice-like network of support elements connected together at points of juncture, and a resilient ball-like buffer is supported by the frame at each juncture point to engage the canopy and thus to prevent its direct engagement with the frame at such points. The preferred ball-like buffer is gas filled, and the preferred frame elements comprise pipes or tubes which are connected to a source of gas, such as nitrogen or air, under pressure. The frame elements, or at least one of them at each juncture point has an outlet connected to the buffer so that all of the buffers in the building construction are maintained at substantially the same pressure. A still further feature of the concept involves a safety valve arrangement whereby if a rupture occurs at one of the buffers or in a structural element pipe, there will not be a loss of pressure in all of the canopy sustaining buffers. This will permit repair or replacement as is needed at a minimal expense and without disrupting the general use of the building construction and enclosure.

DESCRIPTION OF THE DRAWINGS

FIG. 1 is a parti-elevational view of a building construction incorporating the features of the present invention and showing the canopy or skin in section;

FIG. 3 is a schematic illustration of the gas pressure supply system utilized with the invention.

DESCRIPTION OF THE PREFERRED EMBODIMENT

Figure 2:
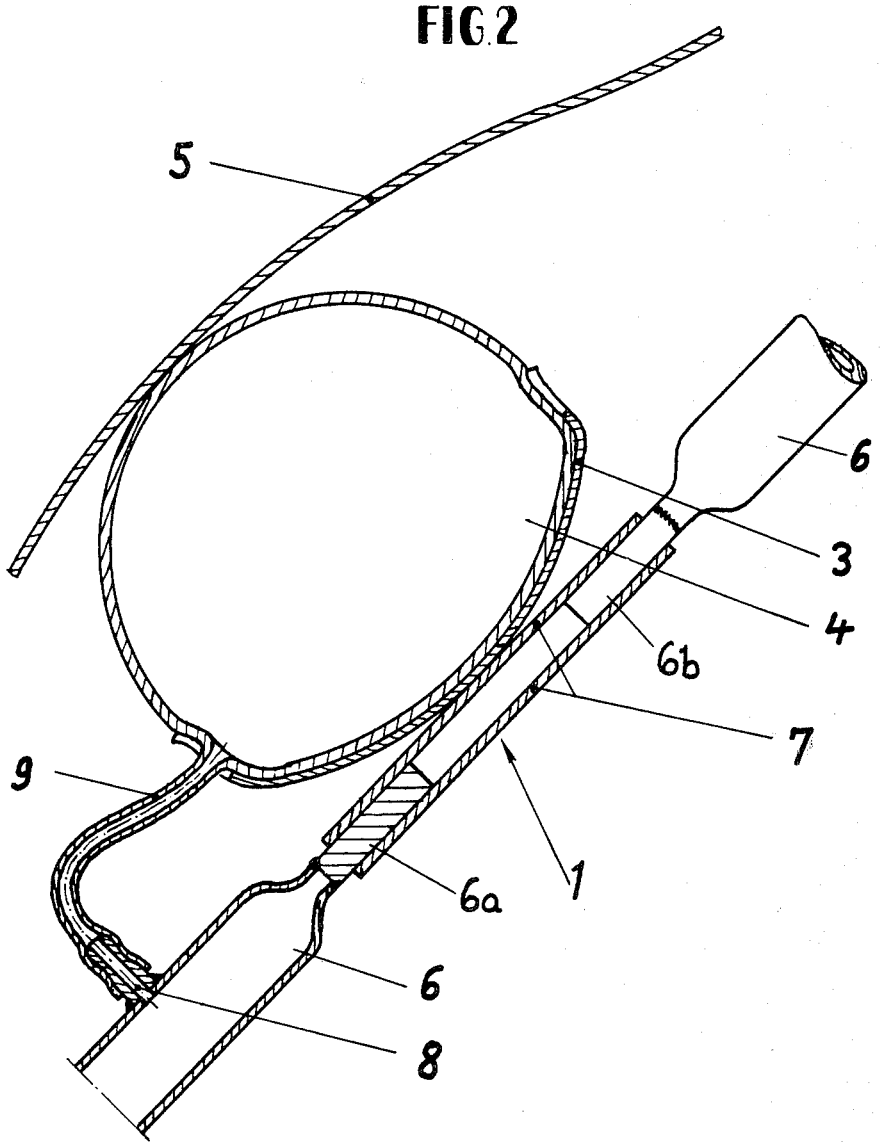
FIG. 2 is a cross-sectional view taken through a juncture point of the frame construction as indicated by the line 2—2 in FIG. 1.

As shown in FIG. 1, a building construction provided in keeping with the present invention comprises a lattice-like frame structure 2 made up of a plurality of elongated frame elements 6 which are arranged with respect to each other as shown in the drawing to be connected together at a plurality of juncture points 1. At each such juncture point a buffer 4 (which will be described in more detail) is connected to the frame structure to support a fabric-like sheet 5, which may be a gas impervious plastic material, which is draped over the frame 2.

It will be observed in FIG. 1 that the frame elements 6 are connected together at juncture points 1 to form the latticelike frame network 2 in three-dimensional configuration extending from a base B. The fabric-like sheet material 5 is thus draped over the frame 2 as a canopy to form an enclosure and is secured along its bottom edge to the base B in any well known and acceptable manner. In many such building constructions, a source of air is provided at slightly more than atmospheric pressure to keep the sheet or canopy 5 slightly expanded and out of general contact with the frame structure 2. However, there will be inevitably some engagement between the canopy or skin and the frame, and heretofore this has been the source of a problem causing great wear and stress to the canopy 5, whether it be inflated or not, at the juncture points 1.

In keeping with the present invention such wear and stress on the canopy or skin is greatly reduced by the provision of a buffer 4 at each juncture point, the preferred form of such buffer being a gas inflated balloon or ball-like element. As better shown at FIG. 2, the gas-filled ball-like buffer 4 is mounted at any juncture point 1 at a plate 3 which is preferably metal but which can be made of any easily deformable material so that it can be bent to embrace and grip a substantial portion of the buffer 4 and thus to hold it. The plate 3 is in turn held as by welding or the like to juncture point plates 7 which form an envelope sealed at its edges and provided with openings along its edges adapted to receive the ends of frame elements 6, 6 as by threading or the like in a gas-tight manner.

As shown in FIG. 1, there are at least two and there may be as many as six or conceivably more frame elements 6 connected together at a junction point 1. In keeping with the invention, each frame element 6 comprises a hollow tube or pipe connected with a source of gas, such as nitrogen or air, under pressure as will be described in more detail hereinafter. The pipes 6, 6 thus supply the gas under pressure to the various buffers 4. As shown in FIG. 2, at each juncture point 1, one of the frame element pipes 6 is provided with a hose or tube connecting outlet 8 receiving a tube extension 9 from the associated buffer 4, thus to inflate the buffer with the air or nitrogen under the pressure in the frame system.

As also shown in FIG. 2, one or more of the gas carrying frame elements 6 may have its end closed as indicated at 6a within the juncture point envelope defined by the plates 7, and still other elements connected at the same juncture point may have open ends such as indicated at 6b within the envelope. This permits a plurality of the frame elements 6 to be connected together in series at different juncture points 1 whereby to define a branch supplying air or nitrogen under pressure to a plurality of buffers. For example, and as shown in FIG. 1, those conduit or pipe frame elements 6 identified as *a*, *a*, *a* may be series connected to form a frame branch 2*a*, those identified as *b*, *b*, *b* being series connected to form frame branch 2*b*, the elements *c*, *c*, *c* being series connected to form branch 2*c* and the elements *d*, *d*, *d* being series connected to form branch 2*d*. Obviously, there can be a plurality of such branches connected in parallel with each other to a single source or supply of the air or nitrogen under pressure.

This is shown in FIG. 3 wherein the reference number 10 designates a pressurized tank or supply of air or nitrogen or other gas under pressure, and the number 11 designates a pressure reducing valve connected to the outlet of the said tank. The controlled pressure outlet of the valve 11 is connected to the parallel branches of the supporting structure framework 2, four of these branches being shown and indicated as 2*a*, 2*b*, 2*c* and 2*d* in FIG. 3. Preferably, each such parallel branch includes a valve 12 which will automatically close and prevent flow into the branch in the event of rupture of one of the elements 6 or a buffer 4 in such branch. Thus, in the event of rupture somewhere in the network, only one branch outlet network suffers the loss of pressure and the remaining branches including all of their buffers are maintained at the same pressure set at the valve 11.

I claim:

1. A building construction including a lattice-like network of support elements connected together at junctures to form a three-dimensional frame for the support of a fabric-like canopy laid thereover as an enclosure which is secured along its bottom edge, a plurality of hollow and resilient ball-like buffers, each of which is supported by the frame at a point of juncture of some of said support elements to engage the canopy and thereby to prevent the said canopy from direct engagement with the frame, particularly at the said juncture point, and at least one of the support elements at each juncture of such elements comprising a conduit connected to the buffer at the juncture point and also connected with a source of gas under pressure whereby all of said buffers are gas filled at the pressure of said source.

2. The improvement in building construction as set forth in claim 1 wherein certain of said conduit-support elements are connected together in series with each other to define a structural branch in parallel relationship with another similarly formed branch of series connected conduit support elements, and wherein a valve is mounted between said source and said branch and operable to close and prevent flow into said branch in the event of rupture and severe loss of pressure therein.

* * * * *